US005158118A

United States Patent [19]

Tate et al.

[11] Patent Number: 5,158,118

[45] Date of Patent: Oct. 27, 1992

[54] SINGLE LAYER PAPER MAKING ON WHICH PLANE SURFACES OF AUXILIARY WEFT THREADS HAVE BEEN FORMED

[75] Inventors: Takuo Tate, Hachioji; Hiroyuki Nagura, Tokyo; Tatsuhiko Yasuoka, Tokyo; Takehito Kuji, Tokyo; Taketoshi Watanabe, Tokyo, all of Japan

[73] Assignee: Nippon Filcon Co., Ltd., Tokyo, Japan

[21] Appl. No.: 672,644

[22] Filed: Mar. 21, 1991

[30] Foreign Application Priority Data

Mar. 27, 1990 [JP] Japan ..... 2-75746

[51] Int. Cl.[5] ..... D03D 13/00

[52] U.S. Cl. ..... 139/383 A

[58] Field of Search ..... 139/383 A

[56] References Cited

U.S. PATENT DOCUMENTS 4,149,571 4/1979 Burroughs .
4,161,195 7/1979 Khan .
4,989,648 2/1991 Tate et al. ..... 139/383 A
4,995,428 2/1991 Tate et al. ..... 139/383 A
4,998,569 3/1991 Tate ..... 139/383 A
5,022,441 6/1991 Tate et al. ..... 139/383 A

FOREIGN PATENT DOCUMENTS 0079431 5/1983 European Pat. Off. .
0085363 8/1983 European Pat. Off. .
2192907 1/1988 United Kingdom .

*Primary Examiner*—Andrew M. Falik
*Attorney, Agent, or Firm*—Beveridge, DeGrandi & Weilacher

[57] ABSTRACT

In a single-layer paper making woven fabric of more than five shafts, auxiliary wefts each having a smaller diameter than that of the primary wefts are disposed between each of the primary wefts. Each of the auxiliary wefts is woven twice into a repeating unit of a texture by a warp. Each auxiliary weft is placed over at least two other warps extending above two adjacent primary wefts. The auxiliary wefts are pushed or urged upwardly thereof by these at least two other warps in order to form a flat paper making surface of the fabric, whereby wire marks on a paper are reduced.

14 Claims, 16 Drawing Sheets

SINGLE LAYER PAPER MAKING ON WHICH PLANE SURFACES OF AUXILIARY WEFT THREADS HAVE BEEN FORMED

TECHNICAL FIELD

The present invention relates to a fabric for paper making.

BACKGROUND ART

In the paper making art with the use of a conventional fourdrinier fabric, a slurry of paper material is supplied to a travelling endless fabric for paper making, on which fabric cellulose fiber is isolated from the slurry to form a wet paper web. The fabric for paper making thus works as a filter for forming a wet paper web. A mesh orifice, referred to also as a drain pore, of the fabric performs a function in isolating water from the slurry. In a fourdrinier paper making machine, the fabric for paper making also works as a driving belt with tension in the machine direction being applied to it, so that it is necessary for the fabric to have stability of its attitude.

There are some problems in the paper making art, particularly in fabrics for paper making, which have the following requirements: high retention of the paper material, i.e. little loss of the raw material being washed away from the paper making surface of the fabric, no generation of wire marks, good drainage capability and low water carrying property, high abrasion resistance, and high stability of attitude.

For the purpose of filling the aforementioned requirements for the fabric for paper making, a variety of proposals have hitherto been made. However, at present none of them have been found satisfactory to meet the above requirements.

For example, a finely woven fabric for paper making which is made of a fine thread in order to prevent the wire marks is deficient in the stability of attitude and has low abrasion resistance. The formation of paper making surfaces with wefts has recently been attempted in order to improve the retention of the paper material. When the paper making surface is formed with wefts, paper material will not directly stop up the drain pores which are present between warps and thus has an effect for improving the draining ability of the fabric. On the other hand, such a paper making surface has a large gap between wefts, so that it has a problem of increasing wire marks.

It has been also proposed that, in a double layer fabric wherein the paper making surface is formed with more wefts that warps, to increase the weft threads on the paper making surface by arranging floats, the so-called floating yarns, as the weft threads. The floating yarns are fine threads not being woven into a weave in the form of interweave of warps and wefts like the usual fabric. This proposal is an interesting technical idea from the viewpoint of increasing the weft threads of the paper making surface. However, this method cannot be said to be practical in actual conditions of paper making. In other words, the weft threads which have not been woven into warp threads are exactly the floating yarns, so that they tend to be displaced and collected together under the fluid pressure applied thereto during the supply of a slurry to the paper making fabric. The result is that the paper making surface cannot be maintained flat or uniform. Accordingly, this method is only of interest as an idea and suffers problems in practical use.

The problem of the wire marks is distinguished particularly in the case of a single layer fabric in which weft yarns form projections on the paper making surface.

Another proposal for the use of a multiple layer fabric has also been made in order to maintain the drainage ability, to make the paper making surface with the fine mesh size and to ensure the surface abrasion resistance.

Recently, the operating speed of a paper making machine has been extensively increased for improving the efficiency of manufacturing paper, which gives rise to another problem. The multiple layer fabric takes advantageous effects, which have not been accomplished by a single layer fabric; it has a large three-dimensional space because of its structure and thus has a high water carrying property. Therefore, if it rotates at a high speed, water retained in the endless fabric is scattered at the turning and rotating part of the paper machine.

On the other hand, a single layer fabric has a low water carrying property, so that no problem as described above will be caused. The single layer, however, has problems that it tends to bring about wire marks as described above and is poor in the retention of paper material and thus in the yield of producing paper.

SUMMARY OF THE INVENTION

The present invention seeks to resolve the aforementioned problems and to provide a paper making fabric having desirable properties of good retention of paper material, no wire marks, good drainage and low water carrying, high abrasion resistance or good stability of attitude. It has been found that the weft density of the paper manufacturing surface must be increased for improving the retention of paper material and a single layer fabric in place of a multiple layer fabric is inevitably required for lowering the water carrying.

In one aspect, the present invention relates to a single fabric for paper making having an integral weave which has warp threads woven once with weft threads, a running or wear surface formed with long crimped primary weft threads and 5 or more shafts in a repeating unit. The single fabric has an integral weave in which auxiliary weft threads having smaller diameter than the primary weft threads are arranged in parallel with respective primary weft threads and are woven twice with warp threads from the paper making surface side. The auxiliary weft threads are pushed upwardly at two or more positions between the places in which said auxiliary weft threads are woven with the warp threads to form a plane surface of auxiliary weft threads on the paper making surface.

The single fabric of the invention has a horizontal plane of the auxiliary weft threads on the paper making surface which are arranged in parallel with respective threads and are woven from the running or wear surface side with the same warp threads as used for weaving respective primary weft threads from the wear surface side. The auxiliary weft threads are woven from the paper making surface with warp threads which are adjacent to the warp threads.

Variations of the single fabric for paper making according to the invention include fabrics where the single fabric has an integral weave which has 8, 9 or 10 shafts in a repeating unit. In those variations, the auxiliary weft threads are pushed upwardly at five, six or seven positions, respectively, between the places where the auxiliary weft threads are woven with the warp threads.

In yet another embodiment, the present invention provides a single fabric for paper making having a horizontal plane of the auxiliary weft threads on the paper making surface wherein the single fabric is a 7, 8, 9 or 10 shaft fabric for paper making which has two adjacent warp thread pairs woven once with primary weft threads and a running or wear surface formed with crimped primary weft threads. The auxiliary weft threads are arranged in parallel with respective primary weft threads and are woven twice with warp threads from the paper making surface side. The auxiliary weft threads are pushed upwardly at three, four, five or six positions, respectively, between the places where the auxiliary weft threads are woven with the warp threads.

In the single fabric of the invention at least one, and possibly a plurality of auxiliary weft threads is provided in relation to each primary weft thread.

The fabric for paper making according to the present invention is made of polyamide threads or polyester threads, and the auxiliary weft threads are also preferably polyamide threads or polyester threads. The auxiliary weft threads are arranged in parallel with respective weft threads in a proportion of at least one to each weft thread, or two or more of the auxiliary weft threads can be also arranged with the provision that the fabric maintains a single layer structure.

Basic fabric weaves for the arrangement of the auxiliary weft threads according to the present invention preferably include fabrics such as 4/1 satin, 5/2 satin, 6/2 satin weaves.

The fabric for paper making of the present invention having been constructed as described above has the auxiliary weft threads arranged between the weft threads, so that it is comprehended even from this viewpoint that the paper making surface is rich in the weft threads inclusive the auxiliary weft threads and is formed by the weft threads. Moreover, the auxiliary weft threads are arranged in parallel with respective weft threads, so that the auxiliary weft threads are distributed uniformly.

It is understood from the section taken along the warp thread that the auxiliary weft threads are provided on the warp threads between the knuckles of weft threads projecting over the paper making surface and diminish the unevenness due to the knuckles of the weft threads to form a smooth paper making surface.

Since the fabric for paper making of the present invention forms the long crimps of the weft threads on the wear or running side surface, the warp threads cannot avoid sinking down between the knuckles of the weft threads. The reason of such sinking is that as the strength of the weft threads for pushing up the warp threads is effective only at the warp threads at the both sides of the knuckle. On the other hand, warp threads provided between the knuckles are increased upon forming the long crimps of the weft threads so that the strength of the weft threads for pushing up the warp threads does not reach all of the warp threads and the warp threads disposed over the weft threads and between the weft knuckles inevitably sink down.

One of the features of the present invention resides in the auxiliary weft threads being woven twice with warp threads from the paper making surface side into the repeating unit of a fabric. The auxiliary weft threads, different from the floating yarn, form completely the weave of a fabric, and will not be moved and perform the function of giving stiffness to the fabric to improve the maintenance of the attitude of the fabric.

Another important feature of the present invention is that the fabric of the present invention is strictly a single layer fabric as the fabric for paper making. The fabric of the present invention utilizes the excellent properties of little void volume and thus low water carrying capacity so that water will not scatter from the fabric during high speed paper making operations. At the same time, the fabric of the present invention solves the structural problem of the wire marks caused by the projection of the weft threads over the paper making surface to afford smoothness to paper and to form dewatering space so that the drainage capability is improved. Moreover, the fabric of the present invention has increased weft density of the paper making surface and thereby the retention of paper materials is improved. Therefore, the auxiliary weft threads used in the present invention are required to have a smaller diameter than the weft threads. If the auxiliary weft threads has a large diameter, the dewatering space is diminished by covering it with the auxiliary weft threads having a large diameter. The dewatering space of the paper making surface can be kept satisfactory by reducing the diameter of the auxiliary weft threads.

The most basic feature of the fabric of the present invention resides in the wear or running side surface which is constructed with long crimped weft threads, since, in a repeating unit of the fabric of the present invention, the warp threads have been woven once with the weft threads. The fabric has a good crimping property and a very large abrasion resistant volume of weft threads as well as very few parts of weft threads which do not participate in the abrasion near the knuckle where the warp threads are woven. The result is that the effective abrasion resistance volume is substantially increased and the abrasion resistant is extremely good.

Figure 1:
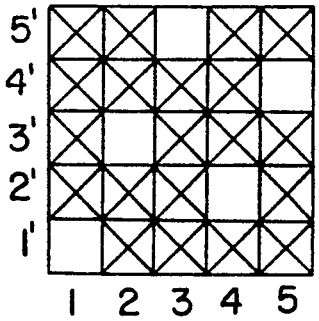
FIG. 1 PRIOR ART
FIGS. 1, 3, 5, 7, 9 and 11 illustrate the textile design chart of the basic units forming the paper making fabric according to the prior art.

In the figures, the numerals denote wrap threads, the numerals provided with prime (') denote weft threads, and the numerals provided with double prime (") denote auxiliary weft threads. The mark X represents the position where the warp thread is on the weft thread, and the triangle Δ represents the position where the warp thread pushes up the weft thread.

DETAILED DESCRIPTION OF THE INVENTION

The present invention is further explained in detail with reference to Examples together with the drawings of schematic designs which illustrate the repeating units.

In the repeating unit drawings, the warp threads are represented by numerals such as 1, 2, 3, etc., the weft threads are represented by numerals provided with prime (') such as 1', 2', 3', etc., and the auxiliary weft threads are represented by the numerals provided with double prime (") such as 1", 2", 3", etc.

In the drawings, X represents the position where the warp thread is on the weft thread and also represents the position where the weft thread is woven with the warp thread into the weave from the paper making surface side.

The clear square □ represents the position where the warp thread is under the weft thread, and also represents the position where the weft thread is woven with the warp thread into the weave from the wear side or running side to surface side or paper making side.

The triangle Δ represents the position where the warp thread pushes up the auxiliary weft thread, and the mark X on the auxiliary weft thread represents the position where the auxiliary weft thread is woven with the warp thread into the weave from the paper making side.

The paper making fabric of the present invention has a repeating unit where the warp thread is woven once with the weft threads, and thus the wear side surface of the fabric is constructed will be the long crimped weft thread. Such a construction is clearly understood from the respective Examples.

FIGS. 1, 3, 5, 7, 9 and 11 are schematic prior art design charts which illustrate the basic units forming the paper making fabric wherein the auxiliary weft threads of the present invention have been arranged.

FIG. 1 is a five shaft fabric of a 4/1 satin weave as prior art.

Figure 2A:
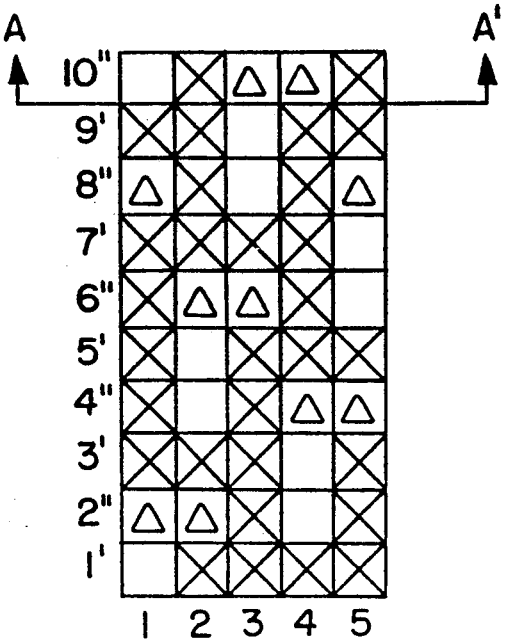
FIGS. 2A, 4A, 6A, 8A, 10A and 12A show textile design charts of the exemplanary unit embodiments of the present invention.
Figure 2B:
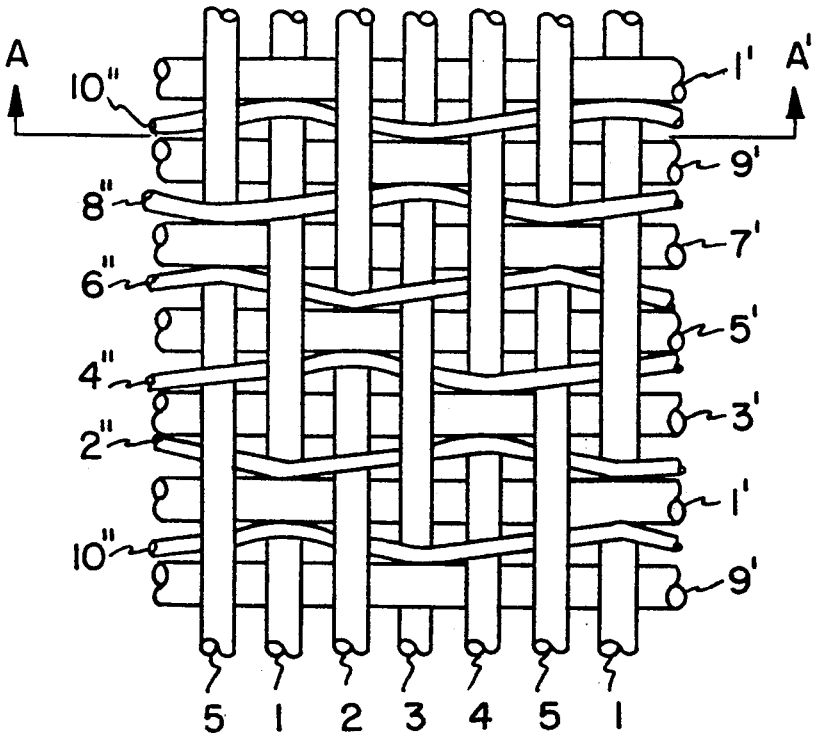
FIGS. 2B, 4B, 6B, 8B, 10B and 12B show plan view of the woven fabrics shown in FIGS. 2A, 4A, 6A, 8A, 10A and 12A.

FIGS. 2A and 2B show an example of the present invention in which an auxiliary weft thread is arranged to each weft thread of the fabric in FIG. 1.

Figure 2C:
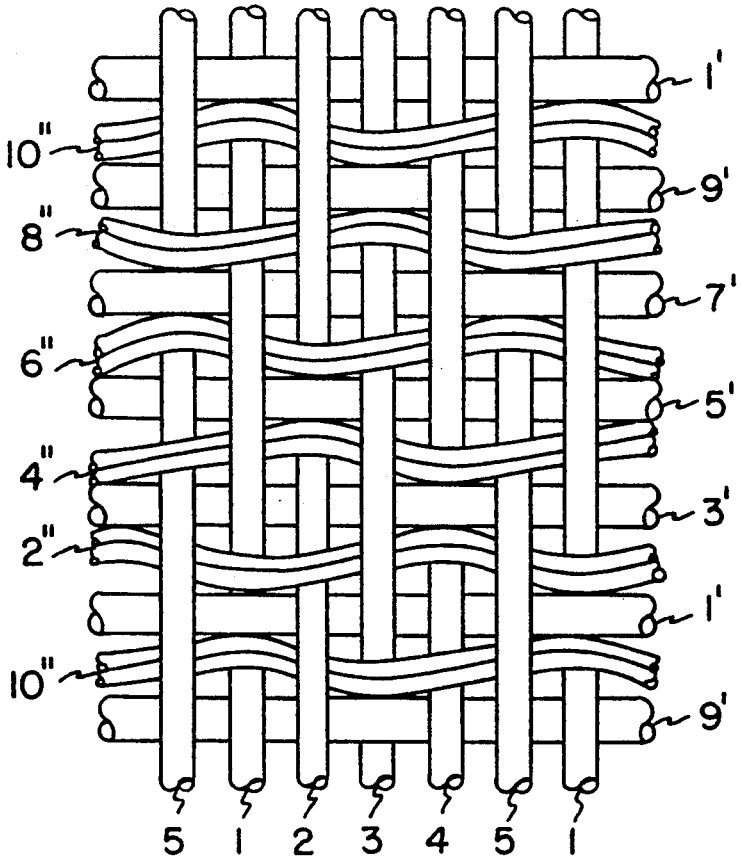
FIG. 2C shows plan view of the woven fabric shown in FIG. 2A wherein two auxiliary wefts threads are disposed between primary weft threads.

FIG. 2C shows another example of the present invention where two auxiliary weft threads are arranged to each weft thread of the fabric in FIG. 1.

Referring to FIGS. 2A, 2B and 2C, the auxiliary weft thread or threads 2" is woven with the warp threads 3 and 5 into the weave at two positions, pushed up at two positions between the warp thread 3 and the left neighboring warp thread in the weave scheme. The auxiliary weft thread or threads 2" thereby forms a smooth plane in such a state as bridging over the recess formed by downwardly sinking warp threads 1 and 2. The auxiliary weft thread or threads 2" are woven from the wear side to the paper making side with the warp thread 4 which weaves the primary weft thread 3' adjacent to the auxiliary weft thread or threads 2" from the wear side. The auxiliary weft thread or threads 2" are woven from the paper making side to the wear side with warp threads 3 and 5 which are adjacent to the warp thread 4, thereby the recess formed by the primary weft thread 3' and the warp 4 is filled. The auxiliary weft or wefts 2" are pushed upwardly by the warps 1 and 2 and particularly pushed by the warp 2 which is extending over the two adjacent over primary wefts 1' and 3' adjacent to the auxiliary weft or wefts 2".

Figure 3:
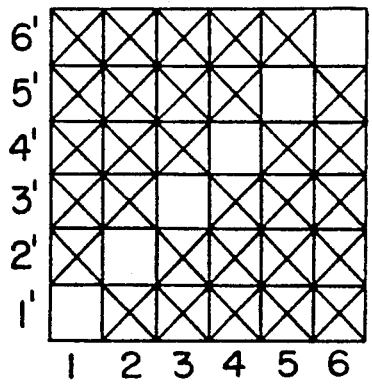
FIG. 3 PRIOR ART

FIG. 3 is a six shaft fabric of a 5/1 satin weave as prior art.

Figure 4A:
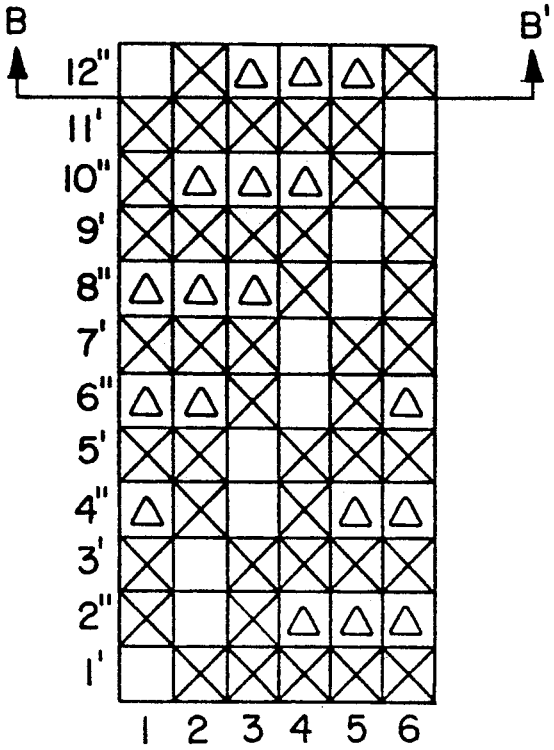
Figure 4B:
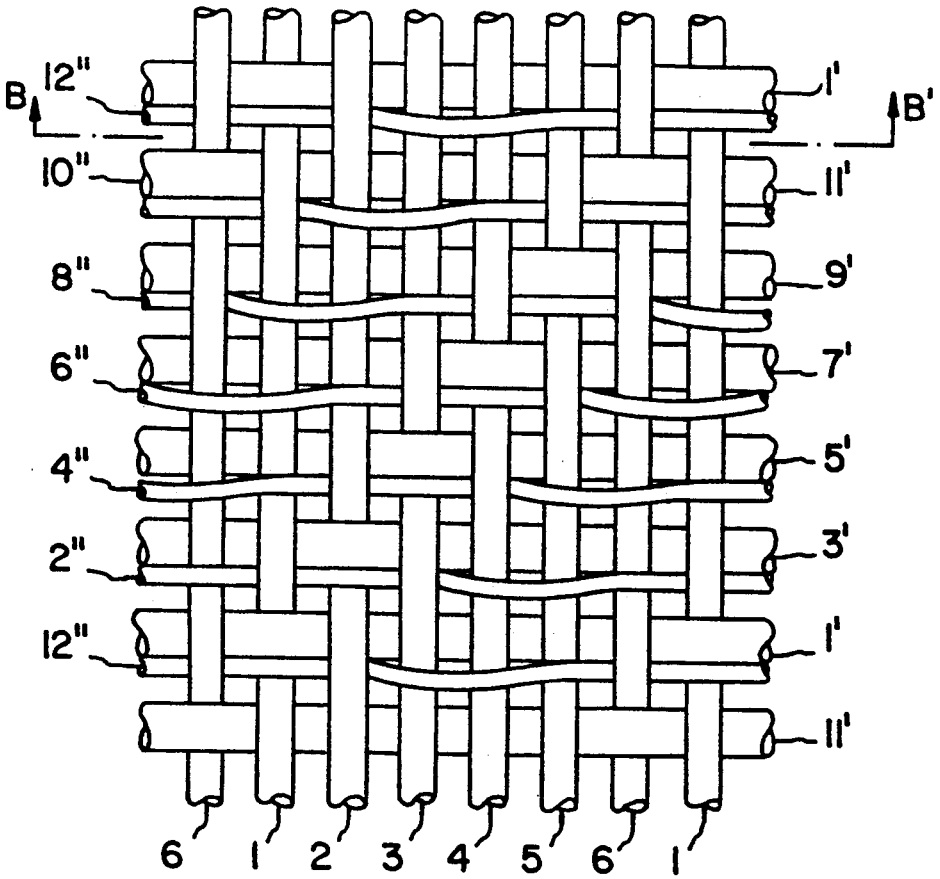

FIGS. 4A and 4B show an example of the present invention in which an auxiliary weft thread is arranged to each weft thread of the fabric in FIG. 3. Referring to the auxiliary weft thread 10", it is understood that auxiliary weft 10" is woven at two positions with warp threads 1 and 5 into the weave, pushed up at three positions between the warp threads 1 and 5 by the warp threads 2, 3 and 4 whereby forms a plane surface arranged on the warp threads 2, 3 and 4. The auxiliary weft thread 10" is woven from the wear side to the paper making side with the warp thread 6 which weaves the primary weft thread 11' adjacent to the auxiliary weft thread 10". The auxiliary weft thread 10" is woven from the paper making side with the warp threads 5 and 1, which are adjacent to the warp thread 6 thereby the recess formed by the primary weft thread 11' and the warp thread 6 is filled. The auxiliary weft 10" is pushed up by warps 2, 3 and 4, and the warps 3 and 4 are extending over two adjacent primary wefts 9' and 11' adjacent to auxiliary weft 10".

Figure 5:
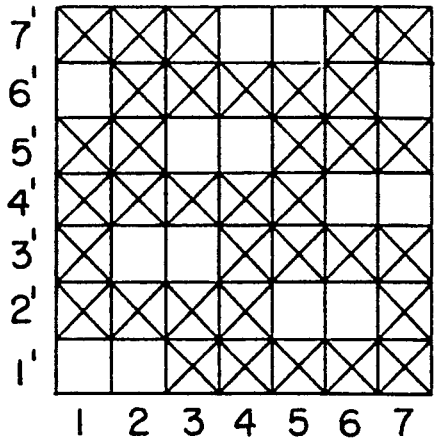
FIG. 5 PRIOR ART

FIG. 5 is a seven shaft fabric of a 5/2 satin weave as prior art. This fabric is a fabric in which a pair of two neighboring warp threads is woven once into the texture with the weft thread whereby forms a wear side surface with long crimped weft threads.

Therefore, the weft threads are bent vigorously and thus are very good in the crimping property. On the other hand, the warp threads tend to sink downwardly and to cause wire marks at these parts.

Figure 6A:
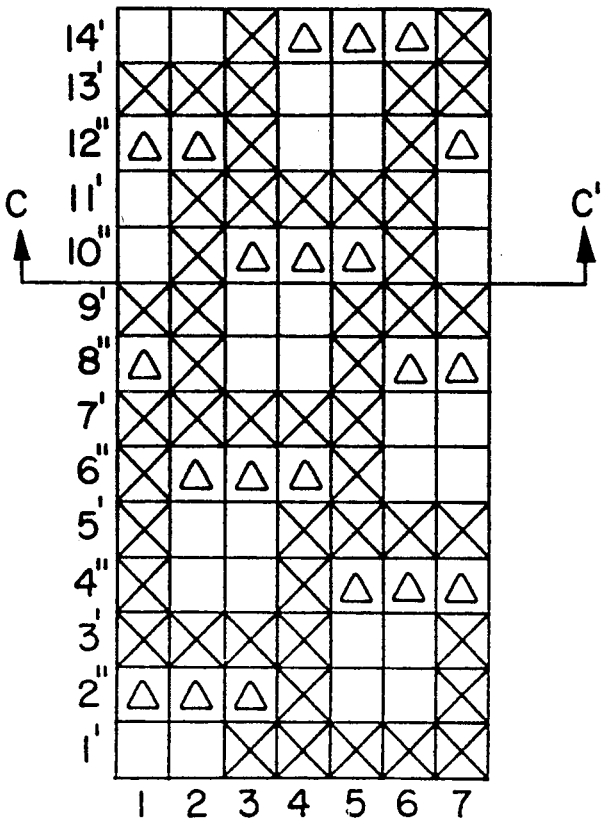
Figure 6B:
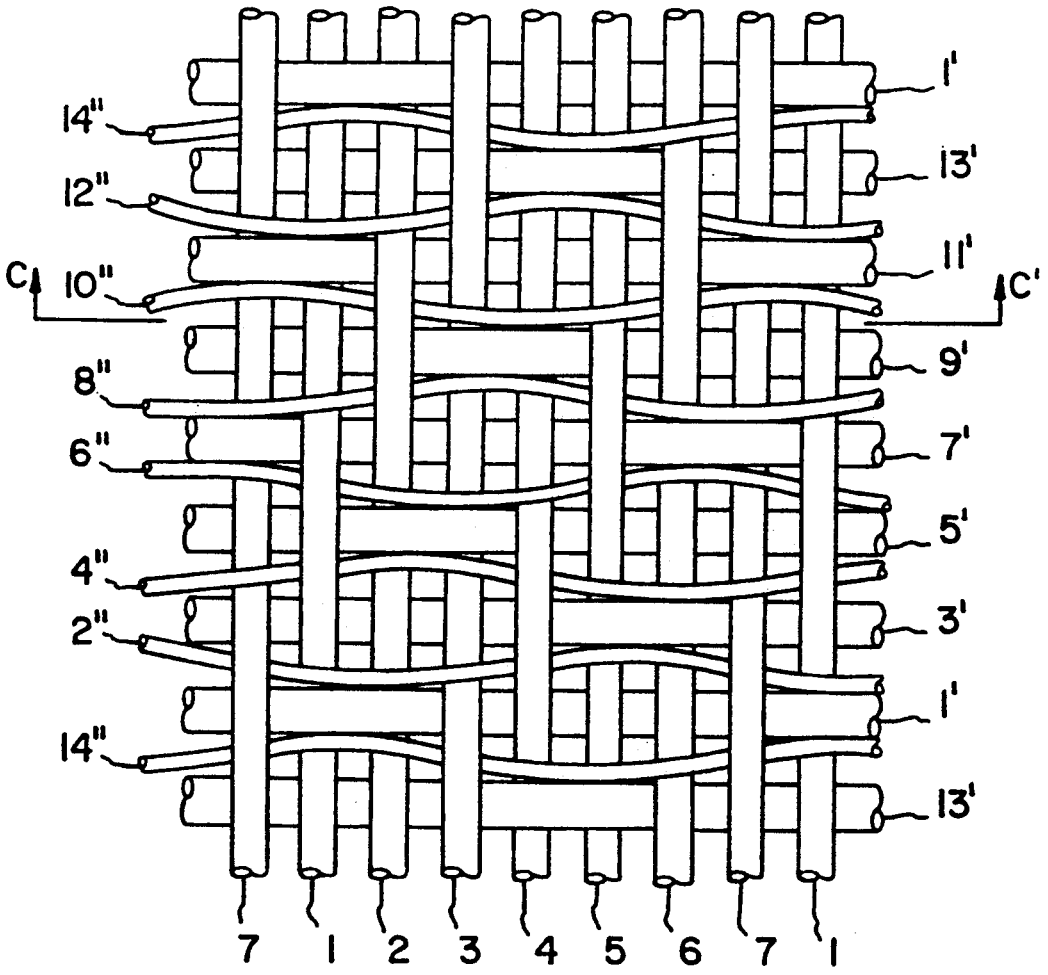

FIGS. 6A and 6B show an example of the present invention in which an auxiliary weft thread is arranged to each weft thread of the fabric in FIG. 5. Referring to the auxiliary weft thread 6", it is woven at two positions with warp threads 1 and 5 into the weave, pushed up at three positions between the warp threads 1 and 5 by the warp threads 2, 3 and 4. It is understood that the auxiliary weft thread 6" is arranged in such a state as to bridge over the recess formed by the downwardly sinking warp threads 2, 3 and 4 thereby forming a plane surface to eliminate the recess. The auxiliary weft thread 6" is woven from the wear side with the warp threads 6 and 7 which weave the primary weft thread 7' adjacent to the auxiliary weft thread 6" from the wear side. The auxiliary weft threads 6" is woven from the paper making side with the warp threads 5 and 1 which are adjacent to the warp threads 6 and 7 whereby the recesses formed by the primary weft thread 7' and warp threads 6 and 7 are filled. The auxiliary weft 6" is pushed up by warps 2, 3 and 4 and warp 4 is extending over two adjacent primary wefts 5' and 7' adjacent to the auxiliary weft 6".

Figure 7:
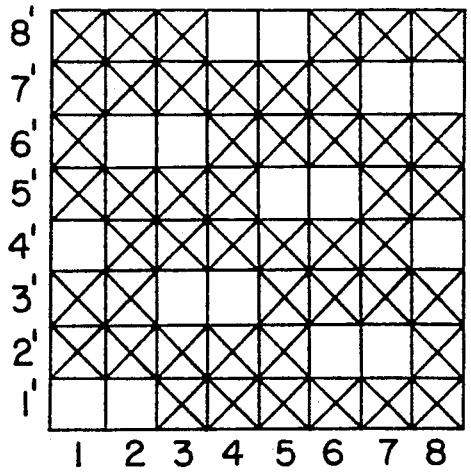
FIG. 7 PRIOR ART

FIG. 7 is an 8 shaft fabric of a 6/2 satin weave as prior art. This fabric is also a fabric in which a pair of two neighboring warp threads is woven once into the texture with the weft thread whereby forms a wear side surface with long crimped weft threads.

Therefore, the weft threads are bent vigorously and thus are very good in the crimping property.

On the other hand, the warp threads tend to sink downwardly and to cause wire marks at these parts.

Figure 8A:
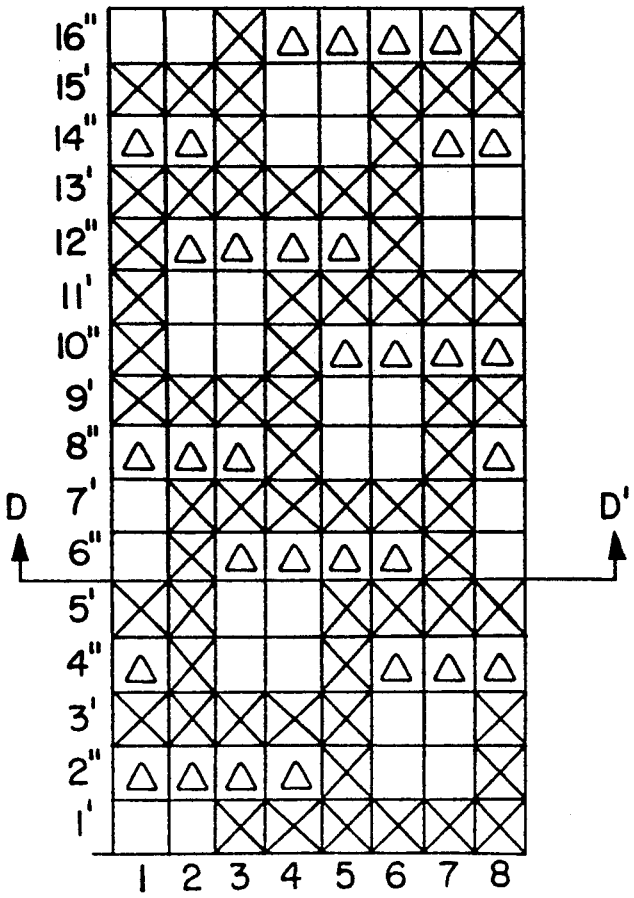
Figure 8B:
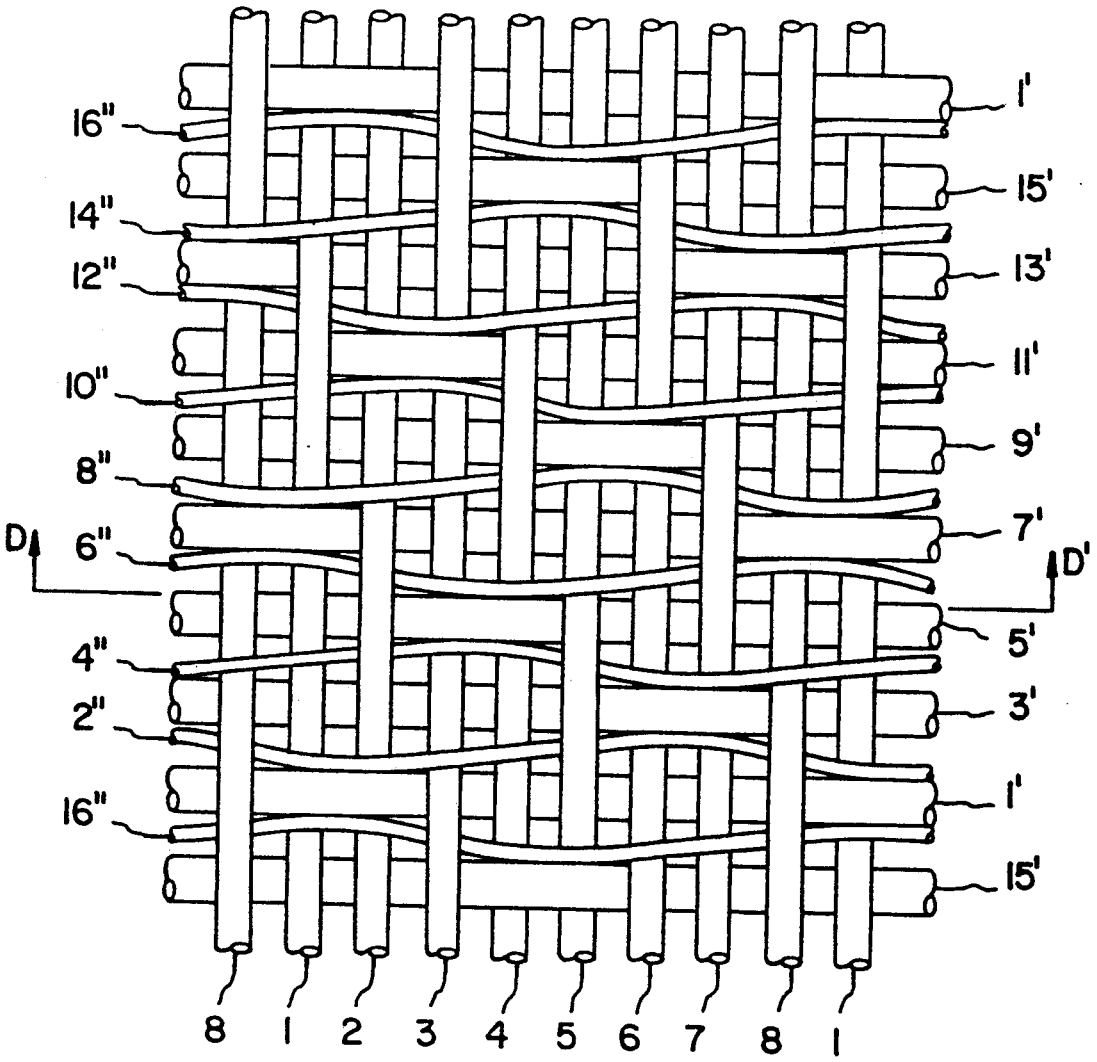

FIGS. 8A and 8B show an example in which an auxiliary weft thread is arranged to each weft thread on the fabric in FIG. 7. Referring to the auxiliary weft thread 6", it is woven at two positions with warp threads 2 and 7 into the weave, pushed up at four positions between the warp threads 2 and 7 by the warp threads 3, 4, 5 and 6. It is understood that the auxiliary weft thread 6" is arranged in such a state as bridging over the recess formed by the downwardly sinking warp threads 3, 4, 5 and 6 whereby constructs a plane surface to eliminate the recess. The auxiliary weft thread 6" is woven from the wear side with the warp threads 8 and 1 which weave the primary weft thread 7' adjacent to the auxiliary weft thread 6" from the wear side. The auxiliary weft thread 6" is woven from the paper making side with the warp threads 7 and 2 which are adjacent to the warp threads 8 and 1 whereby the recesses formed by the primary weft thread 7' and warp threads 8 and 1 are filled. The auxiliary weft 6" is pushed up by warps 3, 4, 5 and 6 and warps 5 and 6 are extending over two adjacent primary wefts 5' and 7' adjacent to the auxiliary 6".

Figure 9:
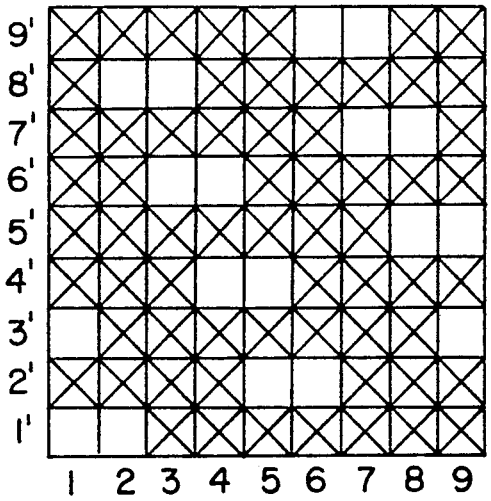
FIG. 9 PRIOR ART

FIG. 9 is a 9 shaft fabric of a 7/2 satin weave as prior art. This fabric is also a fabric in which a pair of two neighboring warp threads is woven once into the texture with the weft thread whereby forms a wear side surface with long crimped weft threads.

Figure 10A:
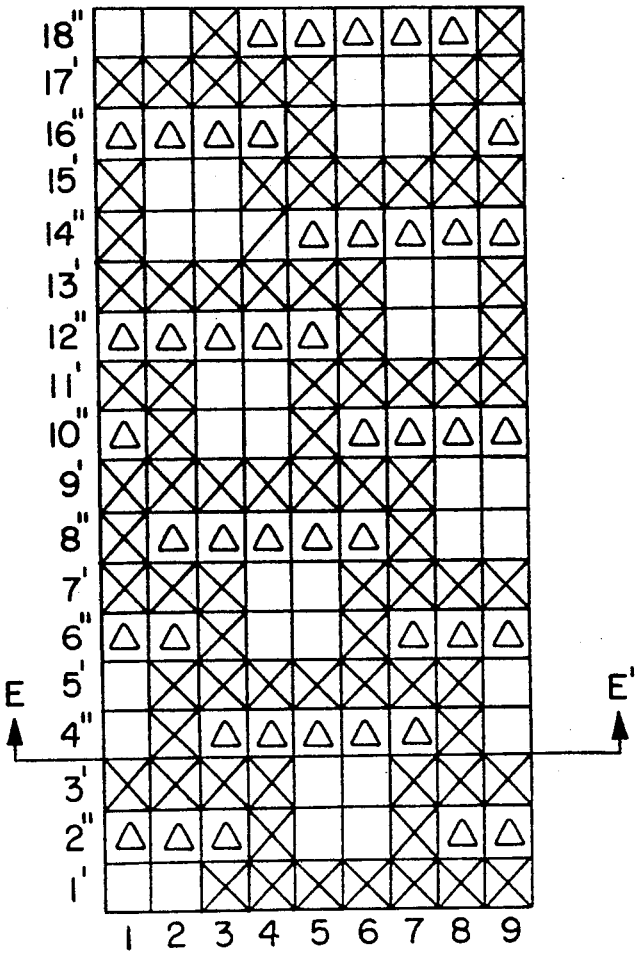
Figure 10B:
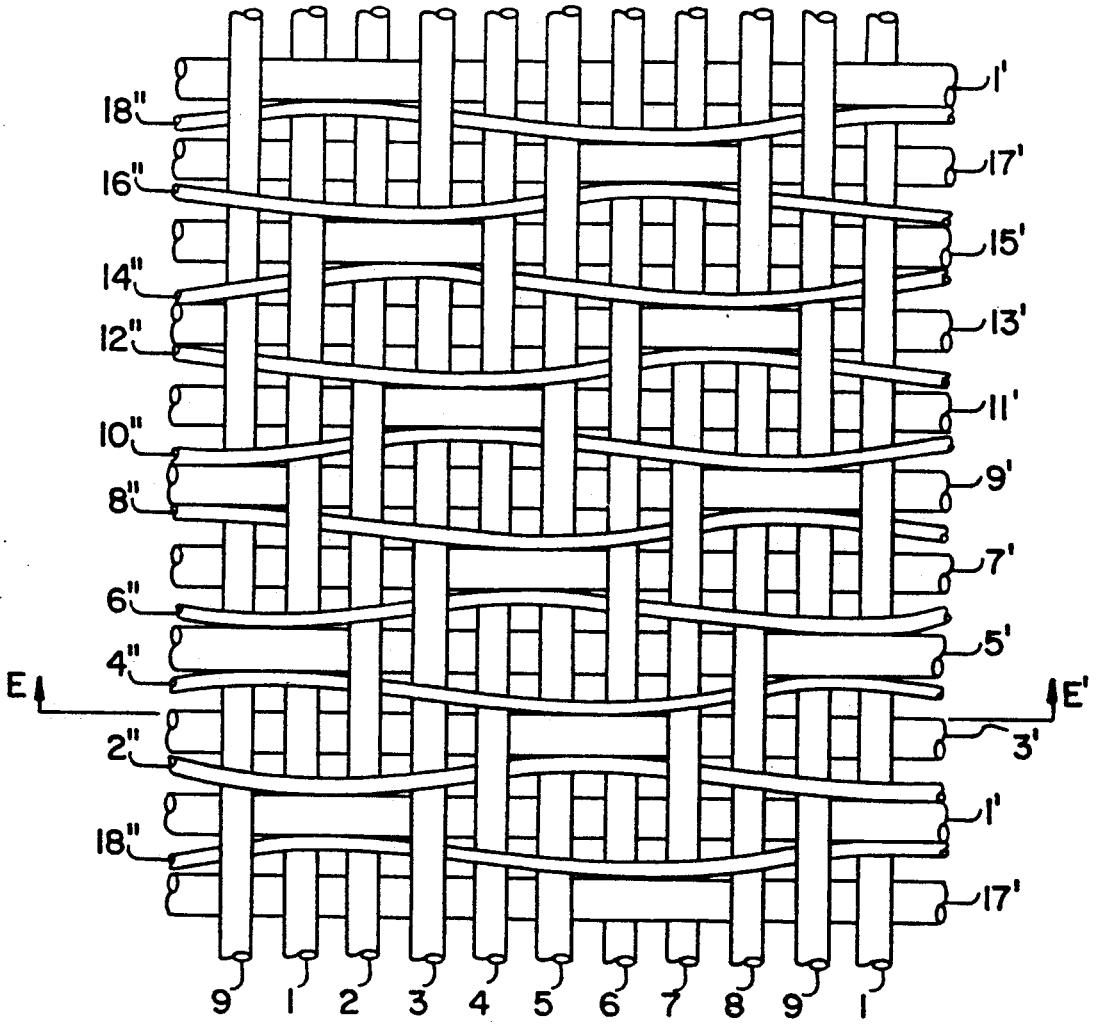

FIGS. 10A and 10B show example in which an auxiliary weft thread is arranged to each weft thread of the fabric in FIG. 9. Referring to FIGS. 10A and 10B, the auxiliary weft thread 4" is woven at two positions with warp threads 2 and 9 into the weave, pushed up at five positions between the warp threads 2 and 9 by the warp threads 3, 4, 5, 6 and 7. The auxiliary weft thread 4" is arranged in such a state as bridging over the recess formed by the downwardly sinking warp threads 3, 4, 5, 6 and 7 and thereby constructs a plane surface. The auxiliary weft thread 4" is woven from the wear side with the warp threads 9 and 1 which weave the primary weft thread 5' adjacent to the auxiliary weft thread 4" from the wear side. The auxiliary weft thread 4" is woven from the paper making side with the warp threads 8 and 2 whereby the recesses formed by the primary weft thread 5' and warp threads 8 and 2 are filled. The auxiliary weft 4" is pushed up by the warps 3, 4, 5, 6 and 7 and the warps 3, 4 and 7 are extending over two adjacent primary wefts 3' and 5' adjacent to the auxiliary 4".

Figure 11:
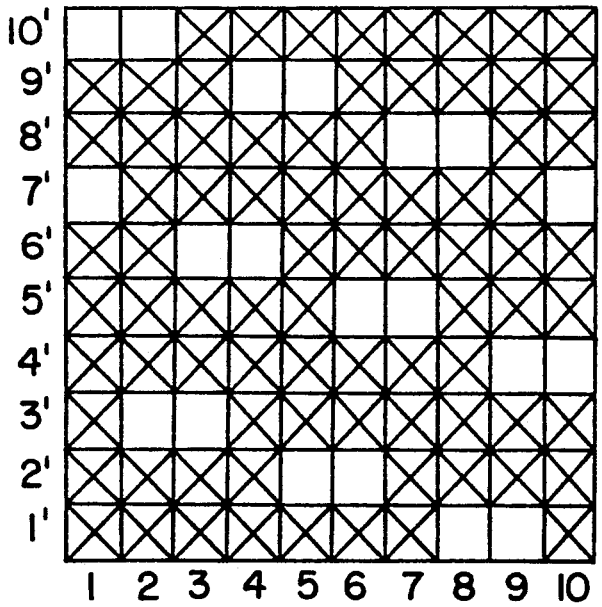
FIG. 11 PRIOR ART

FIG. 11 is a 10 shaft fabric of a 8/2 satin weave as prior art. This fabric is also a fabric in which a pair of two neighboring warp threads is woven once into the texture with the weft thread and which forms a wear side surface with long crimped weft threads.

Figure 12A:
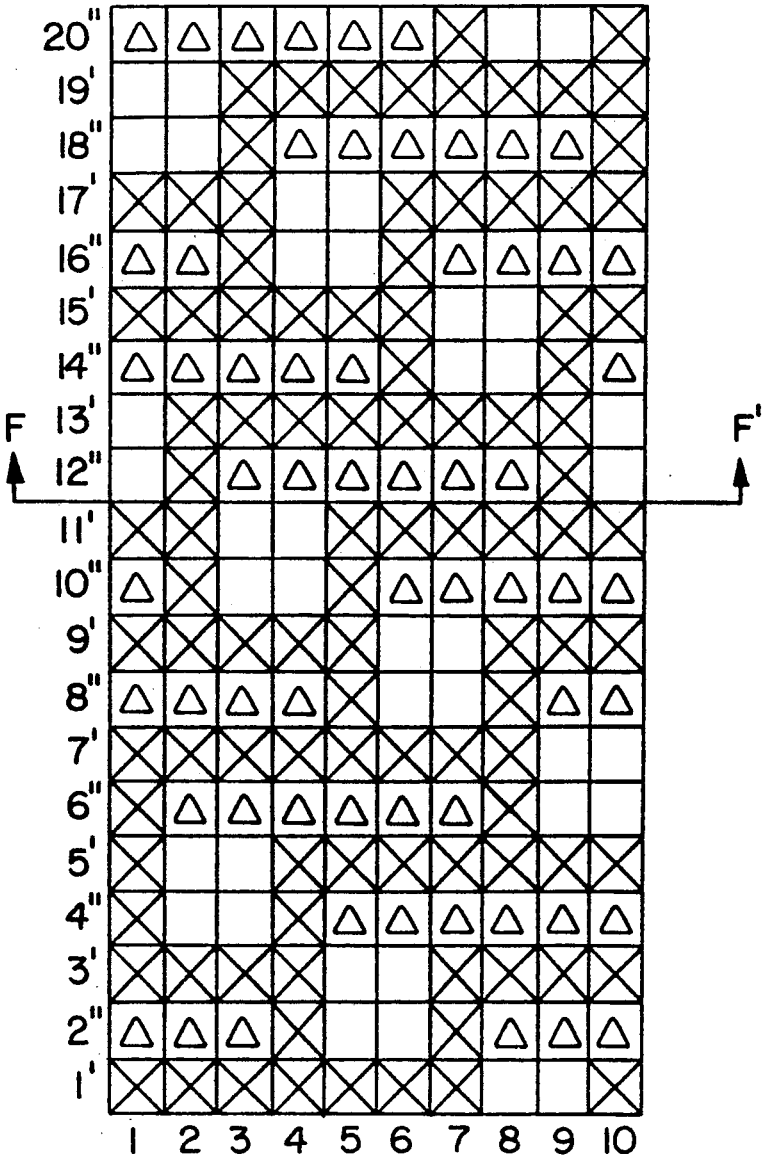
Figure 12B:
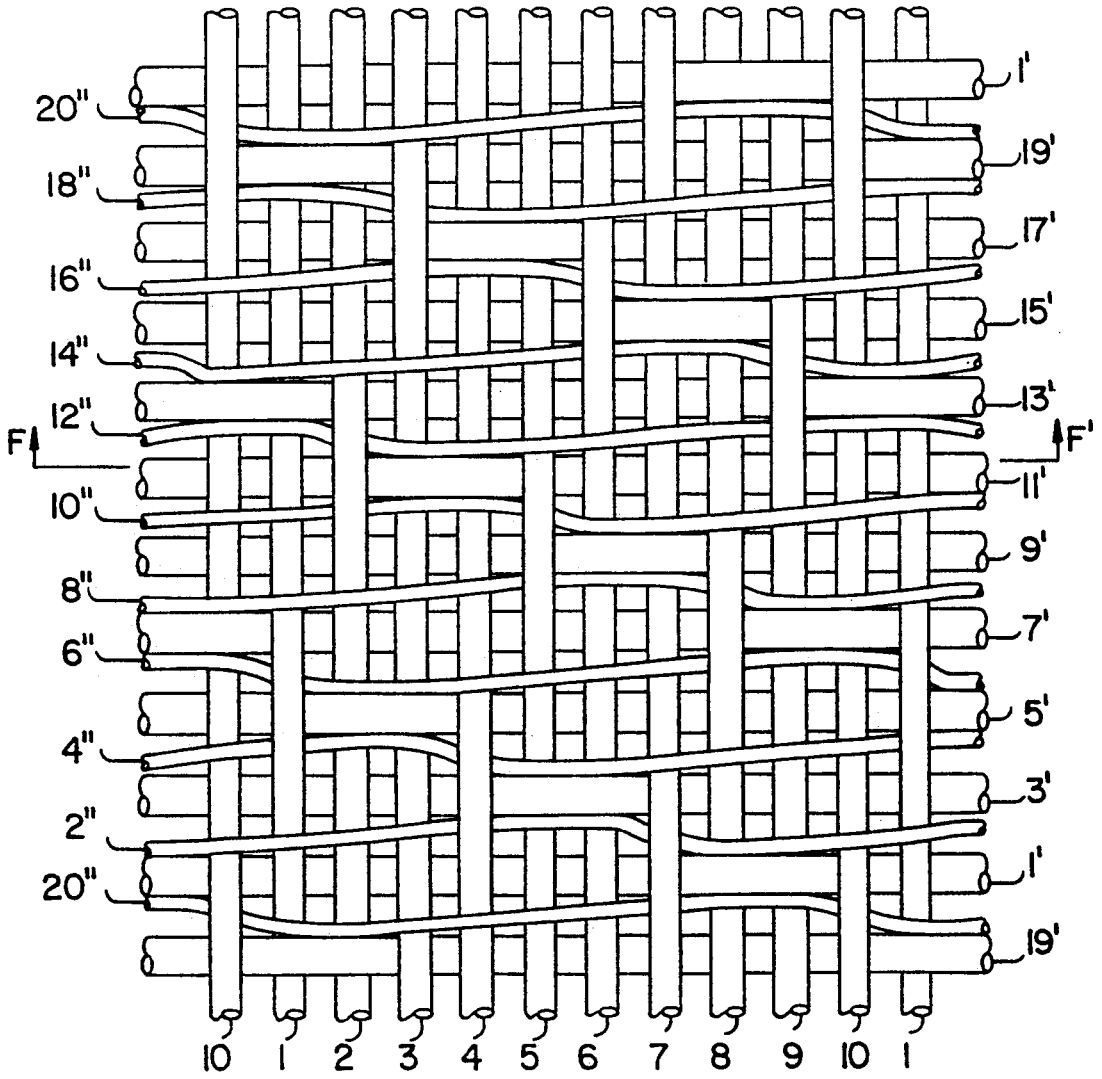

FIGS. 12A and 12B show an example in which an auxiliary weft thread is arranged with each weft thread of the fabric in FIG. 11.

Referring to FIGS. 12A and 12B, the auxiliary weft thread 12" is woven at two positions with warp threads 2 and 9 into the weave, pushed up at six positions by the warp threads 3, 4, 5, 6, 7 and 8. The auxiliary weft thread 12" is arranged in such as state as to bridge over the recess formed by the downwardly sinking warp threads 3, 4, 5, 6, 7 and 8 and thereby constructs a plane surface. The auxiliary weft thread 12" is woven from the wear side with the warp threads 10 and 1 which weave the primary weft thread 13' adjacent to the auxiliary weft thread 12" from the wear side. The auxiliary weft thread 12" is woven from the paper making side with the warp threads 9 and 2 which are adjacent to the warp threads 10 and 1 whereby the recesses formed by the primary weft thread 13' and warp threads 10 and 1 are filled. The auxiliary weft 12" is pushed up by the warps 3 through 8 and the warps 5 through 8 are extending over two adjacent primary wefts 5' and 7' adjacent to the auxiliary 12".

The plane surface formed by the auxiliary weft threads in each example is a paper making surface, and it is understood that the paper making surface of the fabric according to the present invention is a horizontal smooth plane surface.

Figure 13:
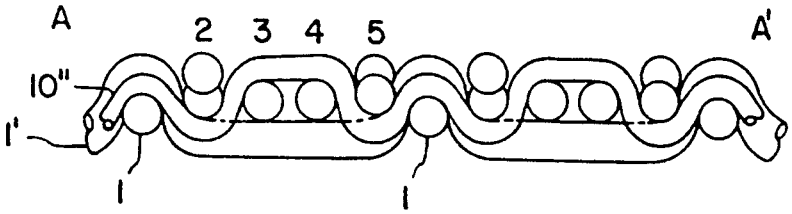
FIG. 13 is a sectional view taken along the line A—A' of FIGS. 2A and 2B.

Next, FIG. 13 is a sectional view of the fabric shown in FIGS. 2A and 2B taken along the line A—A' along the auxiliary weft thread 10" in order to explain the arrangement of the auxiliary weft thread. The fabric is formed by repeating the basic designs shown in FIGS. 2A and 2B right and left and upward and downward direction. The weft thread 1' in FIG. 13 corresponds to the weft thread 1' in FIGS. 2A and 2B. The warp threads 1-5 illustrated in the sectional view correspond to the warp threads 1-5 in FIGS. 2A and 2B. The warp thread 1 is arranged under the weft thread 1', and the warp threads 2, 3, 4 and 5 are arranged on the weft thread 1'. It is understood that the auxiliary weft thread 10" is woven with the warp threads 2 and 5 into the weave from the paper making surface side and arranged on the warp threads 3 and 4 to thereby form a plane surface.

Figure 14:
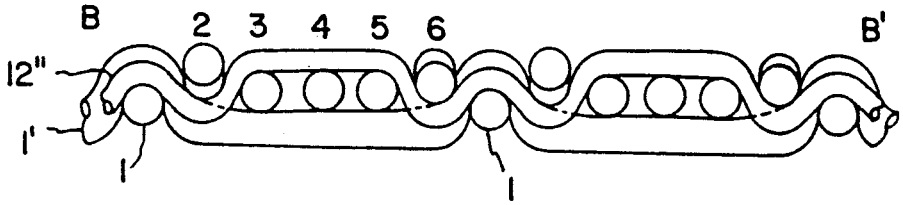
FIG. 14 is a sectional view taken along the line B—B' of FIGS. 4A and 4B.

FIG. 14 is a sectional view of the fabric in FIGS. 4A and 4B taken along the line B—B' along the auxiliary weft thread 12" in order to explain the arrangement of the auxiliary weft threads. The numeral 1' in FIG. 14 is the weft thread 1' in FIGS. 4A and 4B. The warp threads 1-6 illustrated in the sectional view correspond to the warp threads 1-6 in FIGS. 4A and 4B. The warp thread 1 is arranged under the weft thread 1', and the warp threads 2, 3, 4, 5 and 6 are arranged on the weft thread 1'. It is understood that the auxiliary weft thread 12" is woven with the warp threads 2 and 6 into the weave and arranged on the warp threads 3, 4 and 5 to thereby form a plane surface.

Figure 15:
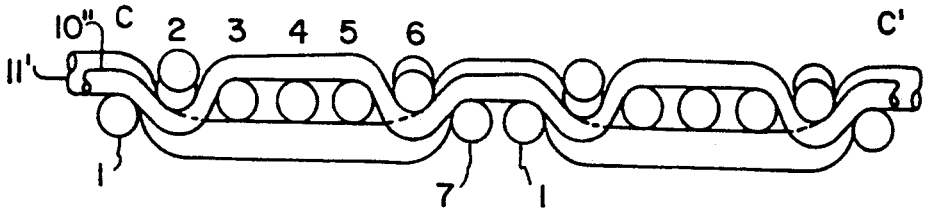
FIG. 15 is a sectional view taken along the line C—C' of FIGS. 6A and 6B.

FIG. 15 is a sectional view of the fabric in FIGS. 6A and 6B taken along the line C—C' along the auxiliary weft thread 10" in order to explain the arrangement of the auxiliary weft threads. The numeral 11' in FIG. 15 is the weft thread 11' in FIGS. 6A and 6B. The warp threads 1-7 illustrated in the sectional view correspond to the warp threads 1-7 in FIGS. 6A and 6B. The warp threads 1 and 7 are arranged under the weft thread 11', and the warp threads 2, 3, 4, 5 and 6 are arranged on the weft thread 11'. It is understood that the auxiliary weft thread 10" is woven with the warp threads 2 and 6 into the weave and arranged on the warp threads 3, 4 and 5 to thereby form a plane surface.

Figure 16:
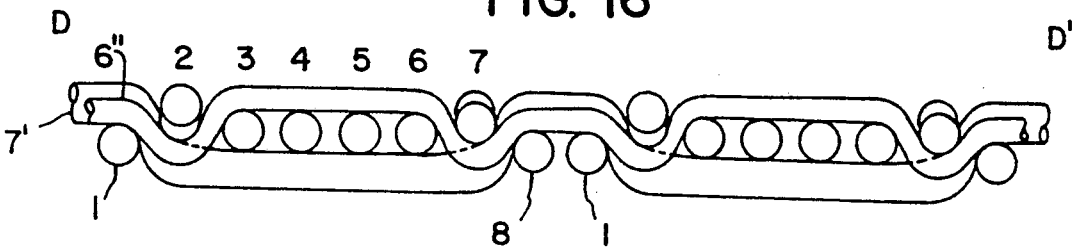
FIG. 16 is a sectional view taken along the line D—D' of FIGS. 8A and 8B.

FIG. 16 is a sectional view of the fabric in FIGS. 8A and 8B taken along the line D—D' along the auxiliary weft thread 6" in order to explain the arrangement of the auxiliary weft threads. The numeral 7' in FIG. 16 is the weft thread 7' in FIGS. 8A and 8B. The warp threads 1-8 illustrated in the sectional view correspond to the warp threads 1-8 in FIG. 8. The warp threads 1 and 8 are arranged under the weft thread 7', and the warp threads 2, 3, 4, 5, 6 and 7 are arranged on the weft thread 7'. It is understood that the auxiliary weft thread 6" is woven with the warp threads 2 and 7 into the weave and arranged on the warp threads 3, 4, 5 and 6 to thereby form a plane surface.

Figure 17:
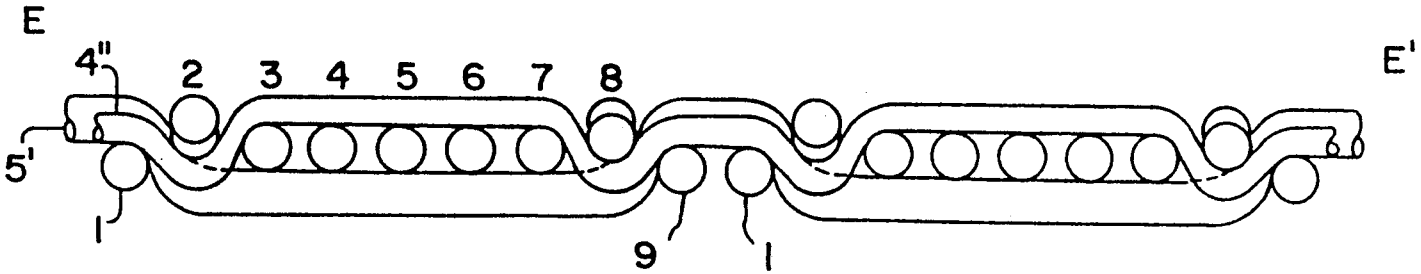
FIG. 17 is a sectional view taken along the line E—E' of FIGS. 10A and 10B.

FIG. 17 is a sectional view of the fabric in FIGS. 10A and 10B taken along the line E—E' along the auxiliary weft thread 4" in order to explain the arrangement of the auxiliary weft threads. The numeral 5 in FIG. 17 is the weft thread 5' in FIGS. 10A and 10B. The warp threads 1–9 illustrated in the sectional view correspond to the warp threads 1–9 in FIGS. 10A and 10B. The warp threads 1 and 9 are arranged under the weft thread 5', and the warp threads 2, 3, 4, 5, 6 and 7 are arranged on the weft thread 5'. It is understood that the auxiliary weft thread 4'' is woven with the warp threads 2 and 8 into the weave and arranged on the warp threads 3, 4, 5, 6 and 7 thereby forming a plane surface.

Figure 18:
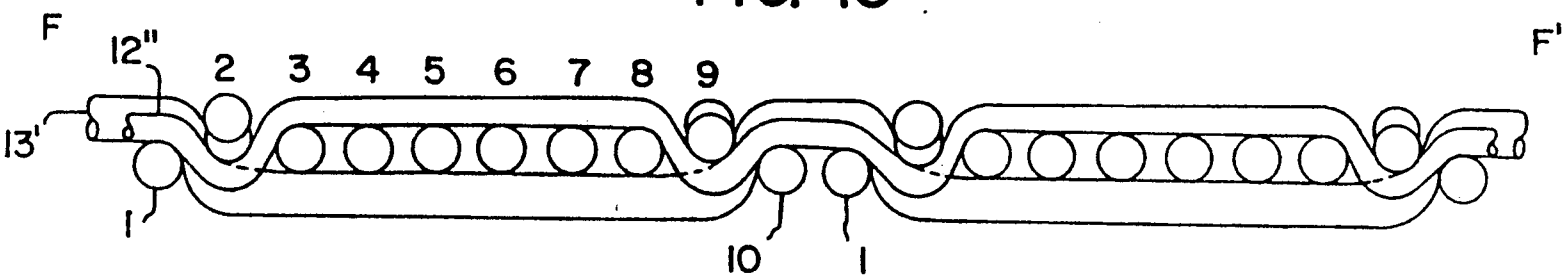
FIG. 18 is a sectional view taken along the line F—F' of FIGS. 12A and 12B.

FIG. 18 is a sectional view of the fabric in FIGS. 12A and 12B taken along the line F—F' along the auxiliary weft thread 12'' in order to explain the arrangement of the auxiliary weft threads. The numeral 13' in FIG. 18 is the weft thread 13' in FIGS. 12A and 12B. The warp threads 1–10 illustrated in the sectional view correspond to the warp threads 1–10 in FIGS. 12A and 12B. The warp threads 1 and 10 are arranged under the weft thread 13', and the warp threads 2, 3, 4, 5, 6, 7, 8 and 9 are arranged on the weft thread 13'. It is understood that the auxiliary weft thread 12'' is woven with the warp threads 2 and 9 into the weave and arranged on the warp threads 3–8 thereby forming a plane surface.

In each of examples described above, two or more auxiliary weft threads may be disposed between each of the primary weft threads in order to obtain the desired property.

EXAMPLE 1

The fabric shown in FIG. 2 was constructed with the threads specified in Table 1, and its test results in addition to the results of a conventional 2/2 twill weave are also shown in Table 1.

TABLE 1

| | Example 1 | Conventional Product |
|---|---|---|
| Weave structure | 4/1 satin weave | 2/2 twill weave |
| Warp thread diameter (mm) | 0.25 | 0.25 |
| Weft thread diameter (mm) | 0.30 | 0.30 |
| Auxiliary weft thread diameter (mm) | 0.13 | |
| Number of warp threads/inch | 58 | 58 |
| Total number of weft threads/inch | 70 | 38 |
| Drainage Capability*1 (sec.) | 5.2 | 5.3 |
| Yield*2 (%) | 73 | 61 |
| Abrasion cutting time*3 | 35 | 21 |
| Smoothness of sheet*4 (sec.) | 86 | 54 |

Note
*1Time required for reaching the water level of 0 for a slurry at a water level of 300 mm when the slurry, which has been made of macerated waste newspaper, and has a freeness of 170 ml and a concentration of 0.04%, is blown at an angle of 15° from its vertical position;
*2Yield = (weight of paper produced/weight of a pulp used) × 100 (%);
*3Measured with an abrasion tester (manufactured by NIPPON FILCON CO.: Registered Utility Model No. 1350124);
*4The smoothness of a paper on the fabric side measured with a BEKK smoothness tester.

In this connection, heavy calcium carbonate was used as a filter.

EXAMPLE 2

The fabric shown in FIGS. 6A and 6B was constructed with the threads specified in Table 2, and its test results in addition to the results of a conventional 3/1 broken twill weave are also shown in Table 2.

TABLE 2

| | Example 2 | Conventional Product |
|---|---|---|
| Weave structure | 5/2 satin weave | 3/1 broken twill weave |
| Warp thread diameter (mm) | 0.25 | 0.25 |
| Weft thread diameter (mm) | 0.27 | 0.30 |
| Auxiliary weft thread diameter (mm) | 0.15 | |
| Number of warp threads/inch | 58 | 58 |
| Total number of weft threads/inch | 70 | 42 |
| Drainage Capability*1 (sec.) | 5.6 | 6.2 |
| Yield*2 (%) | 76 | 66 |
| Abrasion cutting time*3 | 43 | 25 |
| Smoothness of sheet*4 (sec.) | 91 | 62 |

Note 1
*1Time required for reaching the water level of 0 for a slurry at a water level of 300 mm when the slurry, which has been made of macerated waste newspaper and has a freeness of 170 ml and a concentration of 0.04%, is blown at an angle 15° from its vertical position; on the surface of a fabric
*2Yield = (weight of paper produced/weight of a pulp used × 100 (%);
*3Measured with an abrasion tester (manufactured by NIPPON FILCON CO.: Registered Utility Model No. 1350124);
*4The smoothness of a paper on the fabric side measured with a BEKK smoothness tester.

In this connection, heavy calcium carbonate was used as a filler.

The fabric for paper making of the present invention is extremely good in paper making production and good in drainage capability, and has no tendency to impart wire marks and causes no scattering of water. It also has very good abrasion resistance.

We claim:

1. A single layer fabric for paper making which has warp threads woven once with primary weft threads in a repeating unit having a wear side surface formed with long crimped weft threads and 5 or more shafts in said repeating unit, comprising:

auxiliary weft threads having a smaller diameter than the primary weft threads arranged in parallel with respective primary weft threads and are woven twice per said repeating unit with warp threads from the paper making surface side, and said auxiliary weft threads pushed upwardly at two or more positions in said repeating unit between the places in which said auxiliary weft threads are woven with said warp threads to form a plane surface of said auxiliary weft threads on the paper making surface, wherein in said repeating unit said auxiliary weft threads are pushed upwardly at least at one of said two or more positions by warp threads extending over two adjacent primary weft threads adjacent to each of said auxiliary weft thread, and further wherein at least one auxiliary weft thread is provided in relation to each primary weft thread.

2. A single layer fabric for paper making according to claim 1, wherein said auxiliary weft threads arranged in parallel with respective primary weft threads are woven from the wear side surface with the same warp threads as used for weaving respective primary weft threads from the wear side surface, and the auxiliary weft threads are woven from the paper making surface with warp threads which are adjacent to said warp threads.

3. A single layer fabric for paper making according to claims 1 or 2, wherein said single layer fabric has, in the repeating unit, 5 shafts and in which auxiliary weft threads are arranged in parallel with respective primary weft threads and are woven twice with warp threads from the paper making surface side, and said auxiliary weft threads are pushed upwardly at two positions between the places where said auxiliary weft threads are woven with said warp threads.

4. A single layer fabric for paper making according to claims 1 or 2, wherein said single layer fabric has, in the repeating unit, 6 shafts and in which auxiliary weft threads are arranged in parallel with respective primary weft threads and are woven twice with warp threads from the paper making surface side, and said auxiliary weft threads are pushed upwardly at three positions between the places where said auxiliary weft threads are woven with said warp threads.

5. A single layer fabric for paper making according to claims 1 or 2, wherein said single layer fabric has, in the repeating unit, 7 shafts and in which auxiliary weft threads and are arranged in parallel with respective primary weft threads and are woven twice with warp threads from the paper making surface side, and said auxiliary weft threads are pushed upwardly at four positions between the places where said auxiliary weft threads are woven with said warp threads.

6. A single layer fabric for paper making according to claims 1 or 2, wherein said single layer fabric has, in the repeating unit, 8 shafts and in which auxiliary weft threads are arranged in parallel with respective primary weft threads and are woven twice with warp threads from the paper making surface side, and said auxiliary weft threads are pushed upwardly at five positions between the places where said auxiliary weft threads are woven with said warp threads.

7. A single layer fabric for paper making according to claims 1 or 2, wherein said single layer fabric has, in the repeating unit, 9 shafts and in which auxiliary weft threads are arranged in parallel with respective primary weft threads and are woven twice with warp threads from the paper making surface side, and said auxiliary weft threads are pushed upwardly at six positions between the places where said auxiliary weft threads are woven with said warp threads.

8. A single layer fabric for paper making according to claims 1 or 2, wherein said single layer fabric has, in the repeating unit, 10 shafts and in which auxiliary weft threads are arranged in parallel with respective primary weft threads and are woven twice with warp threads from the paper making surface side, and said auxiliary weft threads are pushed upwardly at seven positions between the places where said auxiliary weft threads are woven with said warp threads.

9. A single layer fabric for paper making according to claims 1 or 2, wherein said single layer fabric is a 7 shaft S fabric for paper making which has, in the repeating unit, two adjacent warp thread pairs woven once with primary weft threads and a wear side surface formed with crimped primary weft threads, further wherein the auxiliary weft threads are arranged in parallel with respective weft threads and are woven twice with warp threads from the paper making surface side, and said auxiliary weft threads are pushed upwardly at three positions between the places where said auxiliary weft threads are woven with said warp threads.

10. A single layer fabric for paper making according to claims 1 or 2, wherein said single layer fabric is an 8 shaft S fabric for paper making which has, in the repeating unit, two adjacent warp thread pairs woven once with primary weft threads and a wear side surface formed with crimped primary weft threads, further wherein the auxiliary weft threads are arranged in parallel with respective weft threads and are woven twice with warp threads from the paper making surface side, and said auxiliary weft threads are pushed upwardly at four positions between the places where said auxiliary weft threads are woven with said warp threads.

11. A single layer fabric for paper making according to claims 1 or 2, wherein said single layer fabric is a 9 shaft S fabric for paper making which has, in a repeating unit, two adjacent warp thread pairs woven once with primary weft threads and a wear side surface formed with crimped primary weft threads, further wherein the auxiliary weft threads are arranged in parallel with respective weft threads and are woven twice with warp threads from the paper making surface side, and said auxiliary weft threads are pushed upwardly at five positions between the places where said auxiliary weft threads are woven with said warp threads.

12. A single layer fabric for paper making according to claims 1 or 2, wherein said single layer fabric is a 10 shaft S fabric for paper making which has, in a repeating unit, two adjacent warp thread pairs woven once with primary weft threads and a wear side surface formed with crimped primary weft threads, characterized in that the auxiliary weft threads are arranged in parallel with respective primary weft threads and are woven twice with warp threads from the paper making surface side, and said auxiliary weft threads are pushed upwardly at six positions between the places where said auxiliary weft threads are woven with said warp threads.

13. A single layer fabric for paper making according to claim 1 wherein an auxiliary weft thread is provided in relation to each primary weft thread.

14. A single layer fabric for paper making according to claim 1 wherein a plurality of auxiliary weft threads are provided in relation to each primary weft thread.

* * * * *